US008960403B2

(12) United States Patent
Xu et al.

(10) Patent No.: US 8,960,403 B2
(45) Date of Patent: Feb. 24, 2015

(54) DEVICE FOR PROCESSING BANKNOTE AND METHOD FOR DETECTING THE CONVEYANCE OF BANKNOTE

(75) Inventors: Chunkai Xu, Weihal (CN); Peng Tao, Weihai (CN); Jigang Zhang, Weihai (CN); Fang Xu, Weihai (CN)

(73) Assignee: Shandong New Beiyang Information Technology Co., Ltd., Weihai (CN)

( * ) Notice: Subject to any disclaimer, the term of this patent is extended or adjusted under 35 U.S.C. 154(b) by 0 days.

(21) Appl. No.: 14/114,228

(22) PCT Filed: Apr. 24, 2012

(86) PCT No.: PCT/CN2012/074616

§ 371 (c)(1), (2), (4) Date: Oct. 28, 2013

(87) PCT Pub. No.: WO2012/146161

PCT Pub. Date: Nov. 1, 2012

(65) Prior Publication Data

US 2014/0048379 A1 Feb. 20, 2014

(30) Foreign Application Priority Data

Apr. 29, 2011 (CN) ..... 2011 1 0111318

(51) Int. Cl.

| | |
|---|---|
| ***G07F 7/04*** | (2006.01) |
| ***G07D 11/00*** | (2006.01) |
| ***B65H 5/06*** | (2006.01) |

(Continued)

(52) U.S. Cl.

CPC ..... *G07D 11/0036* (2013.01); *B65H 5/062* (2013.01); *B65H 7/04* (2013.01); *B65H 2511/20* (2013.01); *B65H 2513/511* (2013.01); *G07D 7/00* (2013.01); *B65H 2511/521* (2013.01)

USPC ..... 194/206

(58) Field of Classification Search

CPC ..... G07D 7/00; G07D 11/0036; G07F 7/04

USPC ..... 194/200, 203, 205–207; 209/534; 235/379

See application file for complete search history.

(56) References Cited

U.S. PATENT DOCUMENTS 5,242,041 A 9/1993 Isobe
5,450,937 A * 9/1995 Ono et al. ..... 194/203

FOREIGN PATENT DOCUMENTS

CN 1590259 A 3/2005
CN 1886762 A 12/2006

(Continued)

*Primary Examiner* — Mark Beauchaine

(74) *Attorney, Agent, or Firm* — Porter, Wright, Morris & Arthur, LLP

(57) ABSTRACT

The disclosure provides a method for detecting the conveyance status of a banknote, comprising; detecting whether the banknote reaches a first position in a banknote passage within a first predetermined time; detecting whether the banknote reaches a second position in the banknote passage within a second predetermined time when it is determined that the banknote has reached the first position (S14); determining whether the status of the banknote at the first position is changed from Banknote Detected to Banknote Undetected when it is determined that the banknote is withdrawn when it is determined that the status of the banknote at the first position has changed from Banknote Detected to Banknote Undetected (S18). This application can increase the possibility of the banknote processing device in detecting whether the banknote is withdrawn. Meanwhile, the disclosure provides a device for processing a banknote.

11 Claims, 5 Drawing Sheets

(51) Int. Cl.
*B65H 7/04* (2006.01)
*G07D 7/00* (2006.01)

(56) References Cited

FOREIGN PATENT DOCUMENTS

| | | | |
|---|---|---|---|
| CN | 101107634 | A | 1/2008 |
| CN | 101499188 | A | 8/2009 |
| CN | 101978397 | A | 2/2011 |
| EP | 0333171 | A1 | 9/1989 |
| JP | H08187442 | A | 7/1996 |
| JP | 2006184991 | A | 7/2006 |
| KR | 20010010877 | A | 2/2001 |

* cited by examiner

DEVICE FOR PROCESSING BANKNOTE AND METHOD FOR DETECTING THE CONVEYANCE OF BANKNOTE

FIELD OF THE INVENTION

The disclosure relates to the banknote processing field, and in particular to a device for processing a banknote and a method for detecting the conveyance status of a banknote.

BACKGROUND OF THE INVENTION

Self-service equipment such as vending machine and automatic teller machine becomes more and more popular. Generally, the self-service equipment is equipped with a banknote recognition device, wherein the banknote recognition device includes a banknote recognition mechanism used to recognize the authenticity of a banknote and a banknote box used to save a genuine banknote. Since the self-service equipment is unattended, it is necessary to prevent some lawbreakers from sticking foreign matters such as string or belt on the banknote to withdraw the banknote through the string or belt after the banknote is determined to be genuine by the banknote recognition mechanism before the banknote enters the banknote box.

Therefore, a British patent GB20010015038 provides a solution. Referring to FIG. 1, two sides of the banknote passage used for conveying a banknote are provided with a light-emitting component 22' and a reflector 24 of a paper sensor 16', wherein the light emitted by the paper sensor 16' is parallel to the surface of the banknote 40'; a banknote examination component 14' is arranged perpendicular to the surface of the banknote 40'. After the banknote examination component 14' examines that the banknote is genuine, that is, the banknote 40' passes the examination of the banknote examination component 14', if the paper sensor 16' detects that there is a matter passing through between the light-emitting component 22' and the reflector 24', the system determines that there is a foreign matter entering the banknote passage, that is a string or belt is stuck on the banknote, then the system interrupts the operation and displays transaction failed.

The above solution determines whether the banknote would be withdrawn by detecting a foreign matter attached on the banknote. However, since the foreign matter attached on the banknote generally is a threadlike matter such as string and belt, the detected area is relatively small and the light emitted by the sensor probably can not irradiate the foreign matter; thus, the detection result probably is unreliable and unnecessary loss is easily caused.

SUMMARY OF THE INVENTION

The disclosure aims at providing a device for processing a banknote and a method for detecting the conveyance status of a banknote, to solve the problem existing in conventional art that the detection result is unreliable when the banknote processing device detects whether the banknote is withdrawn.

In order to achieve the purpose above, according to one aspect of the disclosure, a banknote processing device (for example, banknote recognizer) is provided. The banknote processing device includes: a banknote recognition mechanism, which is configured to detect the authenticity of a banknote; a first position sensor, which is arranged on a banknote passage, downstream the banknote recognition mechanism, and is configured to detect whether the banknote reaches a first position in the banknote passage after the banknote is determined to be genuine; a second position sensor, which is arranged on the banknote passage, downstream the first position sensor, and is configured to detect whether the banknote reaches a second position in the banknote passage; and a control mechanism, which is configured to determine whether the banknote reaches the second position in the banknote passage within a second predetermined time when it is determined that the banknote has reached the first position within a first predetermined time, to determine whether the status of the banknote at the first position is changed from Banknote Detected to Banknote Undetected when it is determined that the banknote has not reached the second position within the second predetermined time, and to determine that the banknote is withdrawn when the status of the banknote at the first position has changed from Banknote Detected to Banknote Undetected, wherein the second position is at the downstream of the first position, and both the first position sensor and the second position sensor can detect the banknote when the banknote reaches the second position.

Further, the distance between the first position sensor and the banknote recognition mechanism is less than the length of the banknote in the moving direction.

Further, the distance between the first position sensor and the second position sensor is less than the length of the banknote in the moving direction; moreover, both the first position sensor and the second position sensor can detect the banknote when the banknote reaches the second position.

Further, the control mechanism is further configured to determine whether the banknote reaches a third position in the banknote passage within a third predetermined time after it is determined that the banknote has reached the second position within the second predetermined time, to determine whether there is a banknote at the first position when it is determined that the banknote has not reached the third position in the banknote passage within the third predetermined time, and to determine that the banknote is withdrawn when it is determined that there is a banknote at the first position; wherein the third position is at the downstream of the second position; moreover, the first position sensor can not detect the banknote but the second position sensor can detect the banknote, when the banknote reaches the third position.

Further, the banknote processing device further includes a banknote box, which is arranged at the tail end of the banknote passage and is interconnected with the banknote passage, wherein the control mechanism is further configured to determine whether the banknote reaches a fourth position in the banknote passage within a fourth predetermined time after it is determined that the banknote has reached the third position, to determine whether there is a banknote at the second position and the first position in turn when it is determined that the banknote has not reached the fourth position within the fourth predetermined time, and to determine that the banknote is withdrawn when it is determined that there is a banknote at the second position and the first position in turn; wherein the fourth position is at the downstream of the third position; moreover, when the banknote reaches the fourth the position, the tail end of the banknote enters the banknote box, neither the first position sensor nor the second position sensor can detect the banknote.

In order to achieve the above purpose, according to another aspect of the disclosure, a method for detecting the conveyance status of a banknote is provided. The method for detecting the conveyance status of a banknote includes: detecting whether the banknote reaches a first position in a banknote passage within a first predetermined time after the banknote is determined to be genuine; detecting whether the banknote reaches a second position in the banknote passage within a second predetermined time when it is determined that the banknote has reached the first position, wherein the second position is at the downstream of the first position; determining whether the status of the banknote at the first position is changed from Banknote Detected to Banknote undetected when it is determined that the banknote has not reached the second position within the second predetermined time; and determining that the banknote is withdrawn when it is determined that the status of the banknote at the first position has changed from Banknote Detected to Banknote Undetected.

Further, the distance between the first position and the second position is less than the length of the banknote in the moving direction.

Further, a first position sensor is adopted to detect whether the banknote reaches the first position within the first predetermined time, and a second position sensor is adopted to detect whether the banknote reaches the second position within the second predetermined time, wherein the first position sensor can detect the banknote but the second position sensor can not detect the banknote when the banknote reaches the first position; both the first position sensor and the second position sensor can detect the banknote when the banknote reaches the second position; the distance between the first position sensor and the second position sensor is less than the length of the banknote in the moving direction.

Further, a banknote recognition mechanism is adopted to determine whether the banknote is genuine; the distance between the first position sensor and the banknote recognition mechanism is less than the length of the banknote in the moving direction.

Further, after it is detected, through the second position sensor, that the banknote has reached the second position in the banknote passage within the second predetermined time, the method further includes: determining whether the banknote reaches a third position in the banknote passage within a third predetermined time, wherein the third position is at the downstream of the second position, and the first position sensor can not detect the banknote but the second position sensor can detect the banknote when the banknote reaches the third position; determining whether there is a banknote at the first position when it is determined that the banknote has not reached the third position within the third predetermined time; and determining that the banknote is withdrawn when it is determined that there is as banknote at the first position.

Further, when it is determined that the banknote has reached the third position in the banknote passage, the method further includes: determining whether the banknote reaches a fourth position in the banknote passage within a fourth predetermined time, wherein the fourth position is at the downstream of the third position, the tail end of the banknote enters a banknote box and the second position sensor can not detect the banknote when the banknote reaches the fourth position, wherein the banknote box is arranged at the downstream of the banknote passage and is interconnected with the banknote passage; detecting whether there is a banknote at the second position and the first position in turn when it is determined that the banknote has not reached the fourth position within the fourth predetermined time; determining that the banknote is withdrawn when it is determined that there is a banknote at the second position and the first position in turn.

With the disclosure, after a banknote is determined to be genuine, it is detected whether the banknote reaches a first position in a banknote passage within a first predetermined time; when it is determined that the banknote has reached the first position, it is detected whether the banknote reaches a second position in the banknote passage within a second predetermined time, wherein the second position is at the downstream of the first position; when it is determined that the banknote has not reached the second position within the second predetermined time, it is determined whether the banknote has left the first position; and, when it is determined that the banknote has left the first position, it is determined that the banknote is withdrawn. Since the disclosure determines whether the banknote is withdrawn by detecting the conveyance status of the banknote in the banknote passage, the problem existing in conventional art that the detection result is unreliable when the banknote processing device detects whether the banknote is withdrawn is resolved; therefore, the detection reliability of the banknote processing device in detecting whether the banknote is withdrawn is increased.

BRIEF DESCRIPTION OF THE DRAWINGS

For a better understanding of the disclosure, accompanying drawings described hereinafter are provided to constitute one part of the application; the schematic embodiments of the disclosure and the description thereof are used to illustrate the disclosure but not to limit the disclosure improperly. In the accompanying drawings.

DETAILED DESCRIPTION OF THE EMBODIMENTS

It should be noted that the embodiments hi the application and the characteristics of the embodiments can be combined if no conflict is caused. The disclosure is described below in detail by reference to the accompanying drawings in conjunction with embodiments.

Figure 1:
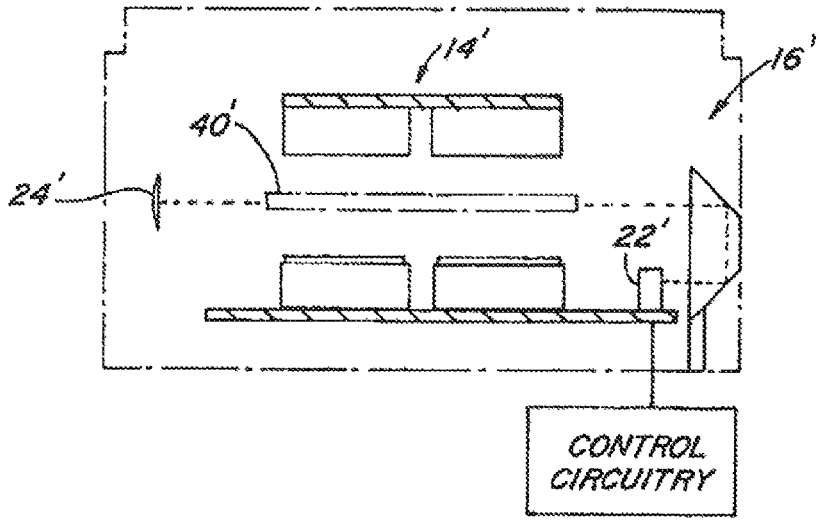
FIG. 1 provides a structure diagram of a banknote processing device provided by a British patent GB20010015038.
Figure 2A:
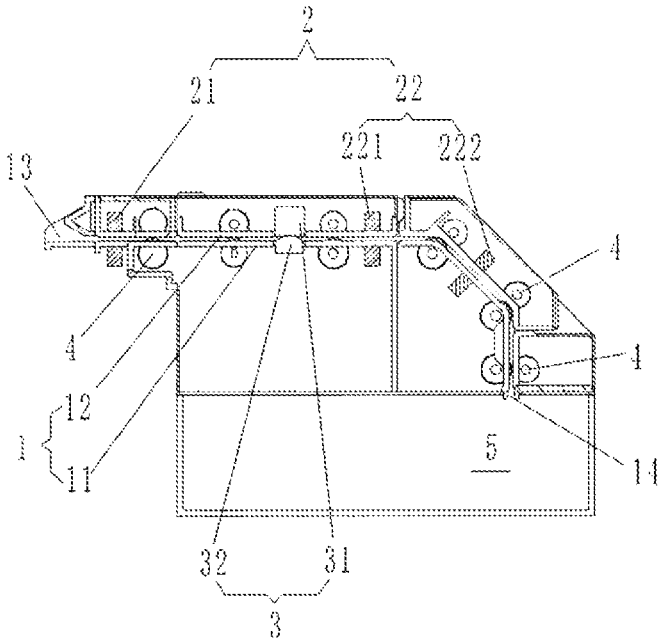
FIG. 2*a* shows a structure diagram of a banknote processing device according to one embodiment of the disclosure.

FIG. 2*a* shows a structure diagram of a banknote processing device according to one embodiment of the disclosure;

Referring to FIG. 2*a*, the banknote processing device includes a frame 1, a sensor component 2, a banknote recognition mechanism 3, a conveying roller set 4, a control mechanism (not shown in FIG. 2*a*), and a banknote box 5, The control mechanism is electrically connected with the sensor component 2, the banknote recognition mechanism 3 and the conveying roller set 4, to control each mechanism to execute corresponding operations.

The frame 1 includes a first passage plate 11 and a second passage plate 12, which are arranged oppositely in parallel to form a banknote passage used for conveying a banknote. One end of the banknote passage is provided with an entrance 13 interconnected with outside, while the other end of the banknote passage is provided with an exit 14 interconnected with the entrance of the banknote box 5.

The banknote recognition mechanism 3 is configured to detect the authenticity of a banknote. According to the recognition feature on the banknote, the banknote recognition mechanism 3 can be a scanning module, or a magnetic read module, or the combination of a scanning module and a magnetic read module, wherein the scanning module is configured to scan the image feature on the banknote surface and the magnetic read module is configured to read the magnetic information on the banknote. The control mechanism compares the scanned image or read magnetic information with a preset data to detect the authenticity of the banknote. In this embodiment, the banknote recognition mechanism 3 is a scanning module, comprising an optical module 31 and a pressure plate 32 opposite the optical module 31, wherein the optical module 31 and the pressure plate 32 are arranged at two sides of the banknote passage, and a banknote passes through between the optical module 31 and the pressure plate 32.

The sensor component 2 is arranged on the banknote passage, comprising a presence sensor 21 used for detecting the presence of a banknote at the entrance 13 and a position sensor 22 used for detecting the position of a banknote in the banknote passage, wherein the presence sensor 21 is arranged at the upstream of the banknote recognition mechanism 3, adjacent to the entrance 13, and is configured to detect whether there is a banknote at the entrance 13; the position sensor 22 is arranged at the downstream of the banknote recognition mechanism 3 and is configured to detect the position of the genuine banknote subjected to recognition in the banknote passage, so that the control mechanism can determine whether the banknote is withdrawn according to a detection signal output by the position sensor 22. There are at least two position sensors 22, and the distance between two adjacent position sensors is less than the banknote length L. In this embodiment, there are two position sensors 22, specifically, a first position sensor 221 and a second position sensor 222, wherein the first position sensor 221 is arranged close to the banknote recognition mechanism 3, and the second position sensor 222 is arranged at the exit 14; preferably, both the distances between the first position sensor 221 and the banknote recognition mechanism 3 and the distance between the first position sensor 221 and the second position sensor 222 are less than the banknote length L. In addition, a plurality of conveying roller sets 4 are arranged along the banknote passage, to convey the banknote disposed at the entrance 13 to the banknote recognition mechanism 3; after the banknote recognition mechanism 3 detects that the banknote is genuine, the conveying roller sets 4 convey the banknote from the exit 14 to the banknote box 5 for saving.

It should be noted that, the sensor in the sensor component 2 might be a photoelectric sensor or a mechanical sensor.

It should be noted that, in other embodiments, when the banknote recognition mechanism 3 is a scanning module, the banknote recognition mechanism 3 also can serve as the first position sensor; in this way, one sensor can be saved and the equipment cost is reduced. Since the control method in the condition of using the scanning module as the first position sensor is the same as the control method in this embodiment, no further description is needed here.

The working principle of the banknote processing device in the embodiment of the disclosure is illustrated below:

The banknote recognition mechanism 3 is configured to detect the authenticity of a banknote;

The first position sensor 221 is arranged on the banknote passage, downstream the banknote recognition mechanism 3, and is configured to detect whether the banknote reaches a first position in the banknote passage after the banknote is determined to be genuine.

The second position sensor 222 is arranged on the banknote passage, downstream the first position sensor 221 and is configured to detect whether the banknote reaches a second position in the banknote passage.

The control mechanism is configured to determine whether the banknote reaches the second position in the banknote passage within a second predetermined time when it is determined that the banknote has reached the first position within a first predetermined time, to determine whether the status of the banknote at the first position is changed from Banknote Detected to Banknote Undetected when it is determined that the banknote has not reached the second position within the second predetermined time, and to determine that the banknote is withdrawn when the status of the banknote at the first position has changed from Banknote Detected to Banknote Undetected, wherein the second position is at the downstream of the first position. Here, determining whether the status of the banknote at the first position is changed from Banknote Detected to Banknote Undetected is to determine whether the banknote detection result of the first position sensor is changed from Banknote Detected to Banknote Undetected; in addition, when the banknote detection result of the first position sensor is changed from Banknote Detected to Banknote Undetected, it is indicated that the banknote has left the first position; therefore, determining whether the status of the banknote at the first position is changed from Banknote Detected to Banknote Undetected also can be understood as determining whether the banknote has left the first position; when it is determined that the banknote has left the first position, it is determined that the banknote is withdrawn.

In the above banknote processing device, it is determined whether a banknote is withdrawn through the detection of the conveyance status of the banknote; thus, after the banknote recognition mechanism 3 determines that the banknote is genuine, it can be determined whether the banknote is withdrawn through the detection of the sequence of the banknote passing through the first position sensor and the second position sensor; compared with the banknote processing device provided by conventional art, the banknote processing device above can increase the detection reliability in detecting whether the banknote is withdrawn.

Preferably, the distance between the first position sensor 221 and the second position sensor 222 is less than the length of the banknote in the moving direction; moreover, both the first position sensor 221 and the second position sensor 222 can detect the banknote when the banknote reaches the second position. The purpose of enabling the distance between the first position sensor 221 and the second position sensor 222 to be less than the length of the banknote in the moving direction is to prevent the occurrence of Banknote Undetected when the banknote is located between the first position sensor 221 and the second position sensor 222, and also to prevent the misjudgement of banknote withdrawal when banknote jam occurs between the first position sensor 221 and the second position sensor 222.

Preferably, the distance between the first position sensor 221 and the banknote recognition mechanism 3 is less than the length of the banknote in the moving direction. The purpose of enabling the distance between the first position sensor 221 and the banknote recognition mechanism 3 to be less than the length of the banknote in the moving direction is to prevent the occurrence of Banknote Undetected when the banknote is located between the first position sensor 221 and the banknote recognition mechanism 3, and also to prevent the misjudgement of banknote withdrawal when banknote jam occurs between the first position sensor 221 and the banknote recognition mechanism 3.

Preferably, the control mechanism is further configured to determine whether the banknote reaches a third position in the banknote passage within a third predetermined time after it is determined that the banknote has reached the second position within the second predetermined time, to determine whether there is a banknote at the first position when it is determined that the banknote has not reached the third position in the banknote passage within the third predetermined time, and to determine that the banknote is withdrawn when it is determined that there is a banknote at the first position; wherein the third position is at the downstream of the second position; moreover; when the banknote reaches the third position, the first position sensor can not detect the banknote but the second position sensor can detect the banknote. In this way, through the banknote processing device in this embodiment, it can be reliably detected that the banknote is withdrawn after reaching the second position sensor 222.

Preferably, the control mechanism is further configured to determine whether the banknote reaches a fourth position in the banknote passage within a fourth predetermined time after it is determined that the banknote has reached the third position, to determine whether there is a banknote at the second position and the first position in turn when it is determined that the banknote has not reached the fourth position within the fourth predetermined time, and to determine that the banknote is withdrawn when it is determined that there is a banknote at the second position and the first position in turn; wherein the fourth position is at the downstream of the third position; moreover, when the banknote reaches the fourth the position, the tail end of the banknote enters the banknote box 5, neither the first position sensor nor the second position sensor can detect the banknote. The banknote box 5 is arranged at the downstream of the banknote passage and is interconnected with the banknote passage. In this way, through the banknote processing device in this embodiment, it can be reliably detected that the banknote is withdrawn after reaching the third position. Here, detecting whether there is a banknote at the second position and the first position in turn and determining that the banknote is withdrawn when it is detected that there is a banknote at the second position and the first position in turn also can be understood as detecting whether the banknote passes through the second position and the first position in turn and determining that the banknote is withdrawn when it is detected that the banknote passes through the second position and the first position in turn.

Figure 2B:
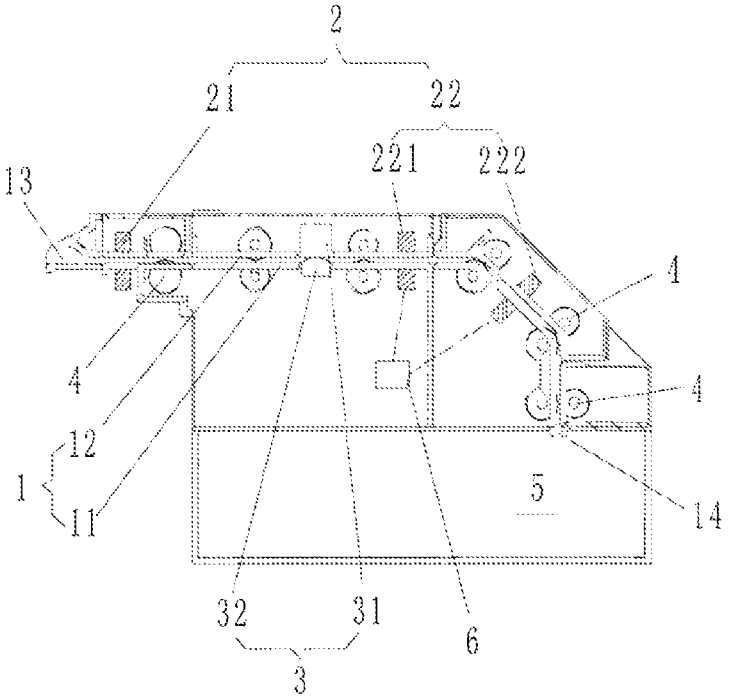
FIG. 2*b* shows a structure diagram of a banknote processing device according to another embodiment of the disclosure.

FIG. 2*b* shows a structure diagram of a banknote processing device according to another embodiment of the disclosure. The difference between the banknote processing device shown in FIG. 2*b* and the banknote processing device shown in FIG. 2*a* is that the position of the control mechanism is shown in FIG. 2*b*. It should be noted that the position of the control mechanism 6 shown in FIG. 2*b* is just to illustrate the position of the control mechanism; the position of the control mechanism 6 only needs to meet the function of the control mechanism mentioned above, for example, the control mechanism 6 can be connected with the first position sensor 221 and the second position sensor 222 in a wired or wireless manner.

The banknote processing device provided by the embodiment of the disclosure can be a banknote recognizer.

Figure 3:
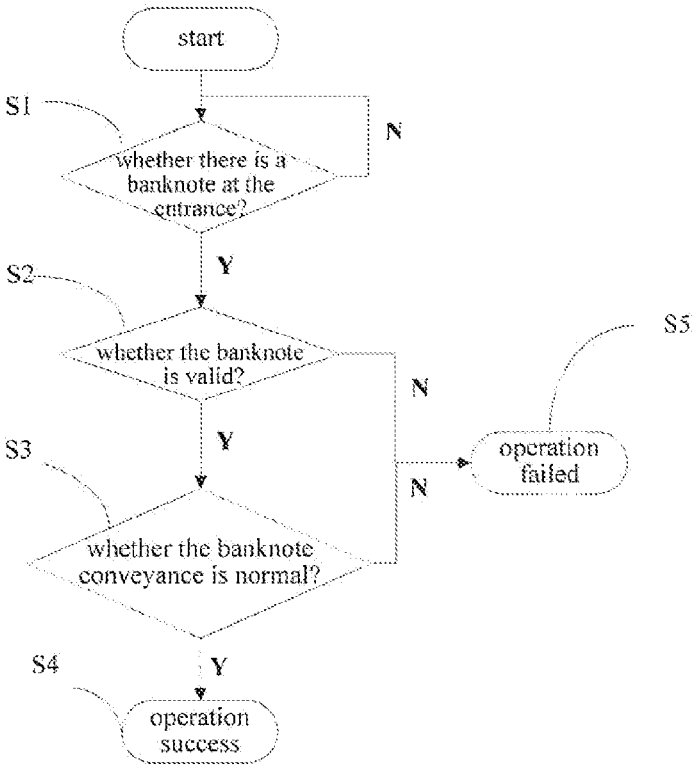
FIG. 3 shows a flowchart of a banknote processing control method of the banknote processing device according to one embodiment of the disclosure.

FIG. 3 shows a flowchart of a banknote processing control method of the banknote processing device according to one embodiment of the disclosure.

Referring to FIG. 3, the banknote processing control method provided by this embodiment includes:

Step 1: whether there is a banknote at the entrance? If so, executing Step 2; otherwise, continuing to detect whether there is a banknote at the entrance.

The presence sensor 21 detects whether there is a banknote at the entrance 13: if the presence sensor 21 detects that there is a banknote at the entrance 13, Step 2 is executed; otherwise, the presence sensor 21 continues to detect whether there is a banknote at the entrance.

When a banknote is disposed at the entrance 13, the banknote covered on the surface of the presence sensor 21 arranged at the entrance 13; then the presence sensor 21 outputs a first detection signal, for example, high level; if there is no banknote covered on the surface of the presence sensor 21, the presence sensor 21 outputs a second detection signal, for example, low level. Thus, according to the change of the signal output by the presence sensor 21, the control mechanism of the banknote processing device can determine whether there is a banknote at the entrance 13.

Step 2: whether the banknote is valid? If so, executing Step 3; otherwise, executing Step 5.

The control mechanism controls the conveying roller set 4 to rotate, so as to convey the banknote to between the optical module 31 and the pressure module 32 of the banknote recognition mechanism 3; then, the optical module 31 scans the image on the banknote, and the control mechanism of the banknote processing device compares the scanned image with the preset data; if the scanned image matches the preset data, the control mechanism determines that the banknote is valid, then Step 3 is executed; otherwise. Step 5 is executed.

Step 3: whether banknote conveyance is normal? if so, executing Step 4; otherwise, executing Step 5.

According to the detection result of the position sensor 22, it is determined whether the banknote is normally conveyed to the banknote box; if so, Step 4 is executed; otherwise, Step 5 is executed.

Step 4: operation success.

After the control mechanism determines that the banknote is normally conveyed to the banknote box, the control mechanism prompts Operation Success; thus, a next operation can be executed.

Step 5: operation failed.

When the control mechanism determines that the banknote is an invalid banknote or the conveyance is abnormal, the control mechanism prompts Operation Failed to the client.

Figure 4:
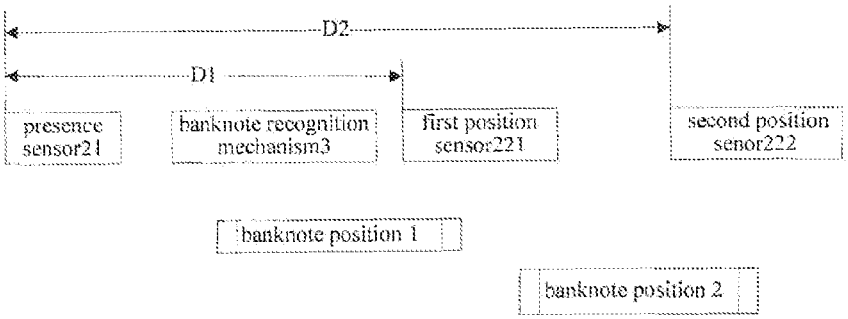
FIG. 4 shows a diagram of the first embodiment of the position status of a banknote in a banknote passage.

FIG. 4 shows a diagram of the first embodiment of the position status of a banknote in a banknote passage.

The control mechanism can determine the position of the banknote in the banknote passage through the detection signal output by the first position sensor 221 and the second position sensor 222. Position 1 refers to the position of the banknote when the head of the banknote has reached the first position sensor 221 but not reached the second position sensor 222, at this time, the first position sensor 221 can detect the banknote while the second position sensor 222 can not detect the banknote; Position 2 refers to the position of the banknote when the head of the banknote has reached the second position sensor 222, at this time the second position sensor 222 can detect the banknote.

Taking the time when the presence sensor 21 detects a banknote at the entrance 13 as the start time, supposing the time when the banknote reaches the Position 1 to be the first predetermined time T1, then the first predetermined time T1 is equal to the distance D1 between the presence sensor 21 and the first position sensor 221 divided by the banknote conveying velocity V, that is, T1=D1/V; supposing the time when the banknote reaches the Position 2 to be the second predetermined time T2, then the second predetermined time T2 is equal to the distance D2 between the presence sensor 21 and the second position sensor 222 divided by the banknote conveying velocity V, that is, T2=D2/V. Preferably, in order to eliminate time error caused by transmission ratio error, a time compensate value Δt is provided according to the transmission error of the banknote, that is, T1=D1/V+/−Δt; T2=D2/V+/−Δt, wherein Δt may be 0.01 seconds or 0.02 seconds.

Figure 5:
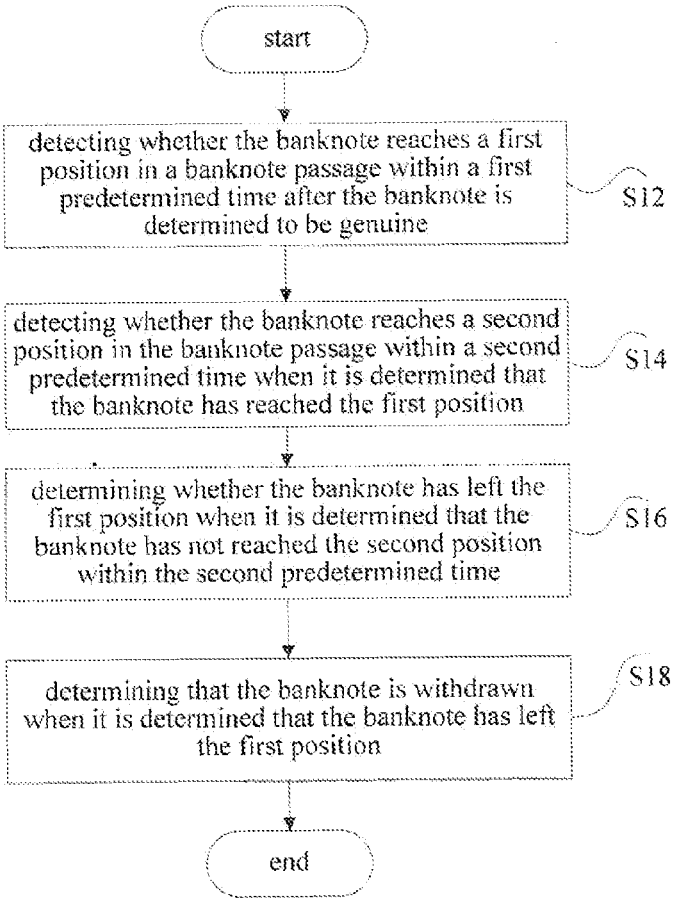
FIG. 5 shows a flowchart of the first embodiment of a method for detecting the conveyance status of a banknote according to the disclosure.

FIG. 5 shows a flowchart of the first embodiment of a method for detecting the conveyance status of a banknote according to the disclosure; Referring to FIG. 5, the banknote processing control method provided by this embodiment includes:

Step 12: detecting whether the banknote reaches a first position in a banknote passage within a first predetermined time after the banknote is determined to he genuine.

Step 14: detecting whether the banknote reaches a second position in the banknote passage within a second predetermined time when it is determined that the banknote has reached the first position, wherein the second position is at the downstream of the first position.

Step 16: determining whether the status of the banknote at the first position is changed from Banknote Detected to Banknote Undetected when it is determined that the banknote has not reached the second position within the second predetermined time.

As mentioned above, determining whether the status of the banknote at the first position is changed from Banknote Detected to Banknote Undetected also can be understood as determining whether the banknote has left the first position.

It is determined whether the banknote has left the first position through a detection signal output by the first position sensor; when the banknote detection result of the first position sensor is changed from Banknote Detected to Banknote Undetected, it is indicated that the banknote has left the first position; when the first position sensor still detects the banknote, it is indicated that the banknote has not left the first position.

Step 18: determining that the banknote is withdrawn when it is determined that the status of the banknote at the first position has changed from Banknote Detected to Banknote Undetected.

In this step, when it is determined that the banknote has left the first position, it is determined that the banknote is withdrawn.

Preferably, the distance between the first position and the second position is less than the length of the banknote in the moving direction.

Preferably, a first position sensor is adopted to detect whether the banknote reaches the first position within the first predetermined time, and a second position sensor is adopted to detect whether the banknote reaches the second position within the second predetermined time; moreover, the first position sensor can detect the banknote but the second position sensor can not detect the banknote when the banknote reaches the first position; both the first position sensor and the second position sensor can detect the banknote when the banknote reaches the second position; the distance between the first position sensor and the second position sensor is less than the length of the banknote in the moving direction.

Preferably, the distance between the first position sensor and the banknote recognition mechanism is less than the length of the banknote in the moving direction.

Figure 6:
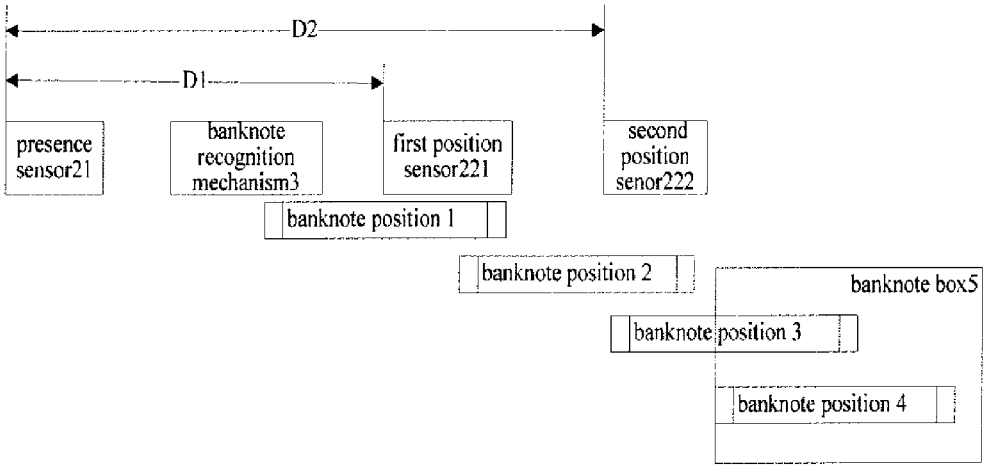
FIG. 6 shows a diagram of the second embodiment of the position status of a banknote inn a banknote passage.

FIG. 6 shows a diagram of the second embodiment of the position status of a banknote in a banknote passage. Referring to FIG. 6, Position 1 refers to the position of the banknote when the head of the banknote has reached the first position sensor 221 but not reached the second position sensor 222; at this time, the first position sensor 221 can detect the banknote while the second position sensor 222 can not detect the banknote; Position 2 refers to the position of the banknote when the head of the banknote has reached the second position sensor 222 while the tail end of the banknote has not left the first position sensor 221; at this time, both the first position sensor 221 and the second position sensor 222 can detect the banknote; Position 3 refer to the position of the banknote when the tail end of the banknote has left the first position sensor 221 but not left the second position sensor 222, that is, the first position sensor 221 can not detect the banknote while the second position sensor 222 can detect the banknote; Position 4 refers to the position of the banknote when the tail end of the banknote has entered the banknote box 5, at this time, neither the first position sensor 221 nor the second position sensor 222 can detect the banknote.

Taking the time when the presence sensor 2.1 detects a banknote at the entrance 13 as the start time, supposing the time when the banknote reaches the Position 1 to be the first predetermined time T1, then the first predetermined time TI is equal to the distance D1 between the presence sensor 21 and the first position sensor 221 divided by the banknote conveying velocity V, that is, T1=D1/V; supposing the time when the banknote reaches the Position 2 to be the second predetermined time T2, then the second predetermined time T2 is equal to the distance D2 between the presence sensor 21 and the second position sensor 222 divided by the banknote conveying velocity V, that is, T2=D2/V; supposing the time when the banknote reaches the Position 3 to be the third predetermined time T3, then the third predetermined time T3 is equal to the sum of the first distance D1 plus the banknote length L divided by the banknote conveying velocity V, that is, T3=(D1+L)/V; supposing the time when the banknote reaches the Position 4 to be the fourth predetermined time T4, then the fourth predetermined time 14 is equal to the sum of the second distance D2 plus the banknote length L divided by the banknote conveying velocity V, that is, T4=(D2+L)/V. Preferably, in order to eliminate time error caused by transmission ratio error, a time compensate value Δt is provided according to the transmission error of the banknote, that is, T1=D1/V+/−Δt, T2=D2/V+/−Δt, T3=(D1+L)/V+/−Δt, T4=(D2+L)/V+/−Δt, wherein Δt might be 0.01 seconds or 0.02 seconds.

Figure 7:
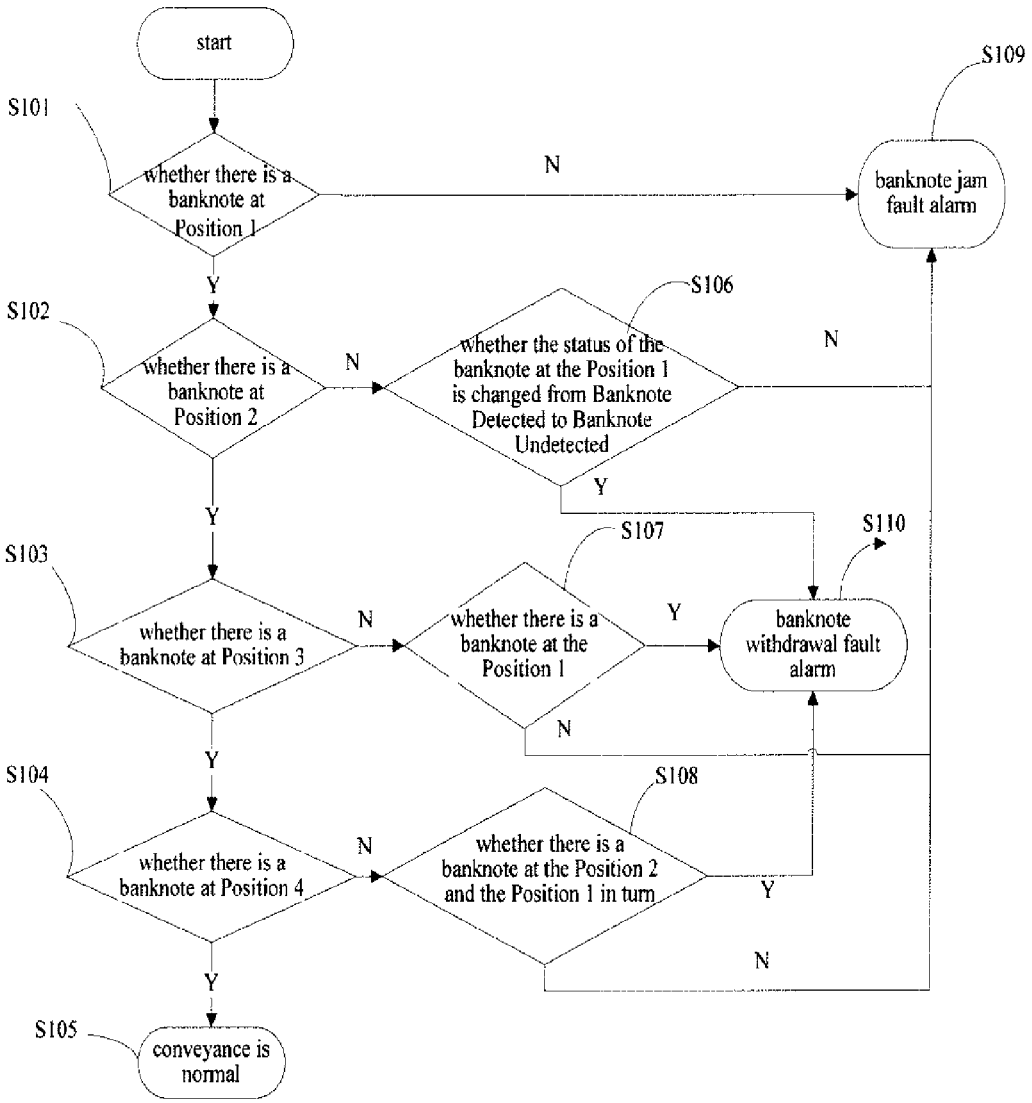
FIG. 7 shows a flowchart of the second embodiment of the method for detecting the conveyance status of a banknote according to the disclosure.

FIG. 7 shows a flowchart of the second embodiment of the method for detecting the conveyance status of a banknote according to the disclosure. Referring to FIG. 7, the method provided by this embodiment for detecting the conveyance status of a banknote includes:

Step 101: determining whether there is a banknote at Position 1; if so, executing Step 102; otherwise, executing Step 109.

Taking the time when the presence sensor 21 detects a banknote at the entrance 13 as the start time, if the first position sensor 221 detects the banknote but the second position sensor 222 does not detect the banknote during the first predetermined time T1, the control mechanism determines that the banknote has been conveyed to the Position 1, then Step 102 is executed; otherwise, Step 109 is executed.

Step 102: determining whether there is a banknote at Position. 2; if so, executing Step 103; otherwise, executing Step 106.

During the second predetermined time T2, if both the first position sensor 221 and the second position sensor 222 detect the banknote, the control mechanism determines that the banknote has been conveyed to the Position 2, then Step 103 is executed; otherwise, Step 106 is executed.

Step 103: determining whether there is a banknote at Position 3; if so, executing Step 104; otherwise, executing Step 107.

During the third predetermined time T3, if the first position sensor 221 does not detect the banknote but the second position sensor 222 detects the banknote, the control mechanism determines that the banknote has been conveyed to the Position 3, then Step 104 is executed; otherwise, Step 107 is executed.

Step 104: determining whether there is a banknote at Position 4; if so, executing Step 105; otherwise, executing Step 108.

During the fourth predetermined time T4, if both the first position sensor 221 and the second position sensor 222 do not detect the banknote, the control mechanism determines that the banknote has been conveyed to the Position 4, that is, the banknote has entered the banknote box 5 through the exit 14, then, Step 105 is executed; otherwise, Step 108 is executed.

Step 105: conveyance is normal.

During the first predetermined time T1, the second predetermined time T2, the third predetermined time T3 and the fourth predetermined time T4, the control mechanism determines that there is a banknote at the Position 1, the Position 2, the Position 3 and the Position 4 in turn, thus the control mechanism determines that the conveyance process of the banknote is normal.

Step 106: determining whether the status of the banknote at the Position 1 is changed from Banknote Detected to Banknote Undetected; if so, executing Step 110; otherwise, executing Step 109.

After the control mechanism determines that there is a banknote at the Position 1, if, during the second predetermined time T2, the control mechanism determines that the banknote has not been conveyed to the Position 2, then the control mechanism determines whether the status of the banknote at the Position 1 is changed from Banknote Detected to Banknote Undetected according to a detection signal output by the position sensor 22 at that time, that is, determines whether the banknote has left the Position 1 according to whether the signal output by the first position sensor 221 is changed from Banknote Detected to Banknote Undetected; if the banknote has left the first position 1, the signal output by the first position sensor is changed from Banknote Detected to Banknote Undetected; if the banknote has not left the Position 1, the signal output by the first position sensor always is Banknote Detected. If the status of the banknote at the Position 1 is changed from Banknote Detected to Banknote Undetected, executing Step 110; otherwise, executing Step 109.

Step 107: determining whether there is a banknote at the Position 1; if so, executing Step 110; otherwise, executing Step 109.

After the control mechanism determines that there is a banknote at the Position I and the Position 2 in turn, if during the third predetermined time T3, the control mechanism determines that the banknote has not been conveyed to the Position 3, then the control mechanism determines whether there is a banknote at the Position 1 according to a detection signal output by the position sensor 2 at that time that is, whether the first position sensor 221 detects the banknote but the second position sensor 222 does not detect the banknote, if so, Step 110 is executed; otherwise, Step 109 is executed.

Step 108: determining whether there is a banknote at the Position 2 and the Position 1 in turn; if so, executing Step 110; otherwise, executing Step 109.

After the control mechanism determines that there is a banknote at the Position 1, the Position 2 and the Position 3 in turn, if, during the fourth predetermined time T4, the control mechanism determines that the banknote has not been conveyed to the Position 4, then the control mechanism determines whether there is a banknote at the Position 2 and the Position 1 in turn according to a detection signal output by the position sensor 22 at that time, that is, whether the banknote passes through the Position 2 and the Position 1 in turn; if the banknote passes through the Position 2 and the Position 1 in turn, first, both the first position sensor 221 and the second position sensor 222 detect the banknote, then it is indicated that banknote is at the Position 2 at that time; next, the first position sensor 221 detects the banknote but the second position sensor 222 does not detect the banknote, then it is indicated that the banknote is at the Position 1; if there is a banknote at the Position 2 and the Position 1 in turn, Step 110 is executed; otherwise, Step 109 is executed.

Step 109: banknote jam fault alarm.

The control mechanism determines that there is a banknote jam fault, gives an alarm and prompts Operation Failed to a user, if any one of the following four conditions occurs.

The first condition is that, during the first predetermined time T1, the control mechanism determines that the banknote has not been conveyed to the Position 1; the second condition is that, during the second predetermined time T2, the control mechanism determines that the banknote has not been conveyed to the Position 2 and has not passed through the Position 1; the third condition is that, during the third predetermined time T3, the control mechanism determines that the banknote has not been conveyed to the Position 3 and has not passed through the Position 1; the fourth condition is that, during the fourth predetermined time T4, the control mechanism determines that the banknote has not been conveyed to the Position 4 and has not passed through the Position 2 and the Position 1.

Step 110: banknote withdrawal fault alarm.

The control mechanism determines that the banknote is withdrawn, gives an alarm and prompts Operation Failed to a user, if any one of the following three conditions occurs.

The first condition is that, during the second predetermined time T2, the control mechanism determines that the banknote has not been conveyed to the Position 2 and meanwhile has passed through the Position 1; the second condition, is that, during the third predetermined time T3, the control mechanism determines that the banknote has not been conveyed to the Position 3 and meanwhile has passed through the Position 1; the third condition is that, during the fourth predetermined time T4, the control mechanism determines that the banknote has not been conveyed to the Position 4 and meanwhile has passed through the Position 2 and the Position 1 in turn.

With the banknote processing control method of the banknote processing device provided by this embodiment, after a banknote is recognized successfully, it is determined whether the banknote passes through two position sensors arranged between the banknote recognition mechanism and the banknote box in turn according to a detection signal output by the two position sensors within a predetermined time, so that the control mechanism can determine whether the banknote is withdrawn; only if the banknote is not conveyed in sequence, the two position sensor certainly detect that the banknote is withdrawn; thus, the banknote processing control method provided by the disclosure can accurately determine whether the banknote is withdrawn illegally and thus avoids unnecessary loss.

From the above description, it can be seen that the disclosure can increase the reliability of the banknote processing device in detecting whether the banknote is withdrawn.

The above are only the preferred embodiments of the disclosure and not intended to limit the disclosure. For those skilled in the art, various modifications and changes can be made to the disclosure. Any modification, equivalent substitute and improvement made within the spirit and principle of the disclosure are deemed to be included within the scope of protection of the disclosure.

What is claimed is:

1. A device for processing a banknote, comprising:

a banknote recognition mechanism (3), which is configured to detect the authenticity of a banknote;

a first position sensor (221), which is arranged on a banknote passage, downstream the banknote recognition mechanism (3), and is configured to detect whether the banknote reaches a first position in the banknote passage after the banknote is determined to be genuine;

a second position sensor (222), which is arranged on the banknote passage, downstream the first position sensor (221), and is configured to detect whether the banknote reaches a second position in the banknote passage;

a control mechanism (6), which is configured to determine whether the banknote reaches the second position within a second predetermined time when it is determined that the banknote has reached the first position within a first predetermined time, to determine whether the status of the banknote at the first position is changed from Banknote Detected to Banknote Undetected when it is determined that the banknote has not reached the second position within the second predetermined time, and to determine that the banknote is withdrawn when the status of the banknote at the first position has changed from Banknote Detected to Banknote Undetected, wherein the second position is at the downstream of the first position.

2. The device for processing a banknote according to claim 1, wherein a distance between the first position sensor (221) and the banknote recognition mechanism (3) is less than a length of the banknote in the moving direction.

3. The device for processing a banknote according to claim 1, wherein a distance between the first position sensor (221) and the second position sensor (222) is less than a length of the banknote in the moving direction; and when the banknote is at the second position, both the first position sensor (221) and the second position sensor (222) can detect the banknote.

4. The device for processing a banknote according to claim 3, wherein the control mechanism is further configured to determine whether the banknote reaches a third position in the banknote passage within a third predetermined time after it is determined that the banknote has reached the second position within the second predetermined time, to determine whether there is a banknote at the first position when it is determined that the banknote has not reached the third position in the banknote passage within the third predetermined time, and to determine that the banknote is withdrawn when it is determined that there is a banknote at the first position; wherein the third position is at the downstream of the second position; and when the banknote is at the third position, the first position sensor (221) cannot detect the banknote but the second position sensor (222) can detect the banknote.

5. The device for processing a banknote according to claim 4, further comprising a banknote box(5) which is arranged at the tail end of the banknote passage and is interconnected with the banknote passage, wherein the control mechanism is further configured to determine whether the banknote reaches a fourth position in the banknote passage within a fourth predetermined time after it is determined that the banknote has reached the third position, to determine whether there is a banknote at the second position and the first position in turn when it is determined that the banknote has not reached the fourth position within the fourth predetermined time, and to determine that the banknote is withdrawn when it is determined that there is a banknote at the second position and the first position in turn; wherein the fourth position is at the downstream of the third position, and when the banknote is at the fourth position, the tail end of the banknote enters the banknote box, neither the first position sensor (221) nor the second position sensor (222) can detect the banknote.

6. A method for detecting the conveyance status of a banknote, comprising:

detecting by a first position sensor, whether a banknote reaches a first position in a banknote passage within a first predetermined time after the banknote is determined to be genuine;

detecting by a second position sensor, whether the banknote reaches a second position in the banknote passage within a second predetermined time when it is determined that the banknote has reached the first position, wherein the second position is at the downstream of the first position;

determining by a control mechanism, whether the status of the banknote at the first position is changed from Banknote Detected to Banknote Undetected when it is determined that the banknote has not reached the second position within the second predetermined time; and determining by the control mechanism, that the banknote is withdrawn when it is determined that the status of the banknote at the first position has changed from Banknote Detected to Banknote Undetected.

7. The method for detecting the conveyance status of a banknote according to claim 6, wherein a distance between the first position and the second position is less than a length of the banknote in the moving direction.

8. The method for detecting the conveyance status of a banknote according to claim 6, wherein a the first position sensor is adopted to detect whether the banknote reaches the first position within the first predetermined time, and the second position sensor is adopted to detect whether the banknote reaches the second position within the second predetermined time; wherein when the banknote is at the first position, the first position sensor can detect the banknote but the second position sensor cannot detect the banknote, when the banknote is at the second position, both the first position sensor and the second position sensor can detect the banknote, and the distance between the first position sensor and the second position sensor is less than the length of the banknote in the moving direction.

9. The method for detecting the conveyance status of a banknote according to claim 8, wherein a banknote recognition mechanism is adopted to determine whether the banknote is genuine, and the distance between the first position sensor and the banknote recognition mechanism is less than the length of the banknote in the moving direction.

10. The method for detecting the conveyance status of a banknote according to claim 8, wherein after it is detected, through the second position sensor, that the banknote has reached the second position in the banknote passage within the second predetermined time, the method further comprises:

determining whether the banknote reaches a third position in the banknote passage within a third predetermined time, wherein the third position is at the downstream of the second position, and, when the banknote is at the third position, the first position sensor cannot detect the banknote but the second position sensor can detect the banknote:

determining whether there is a banknote at the first position when it is determined that the banknote has not reached the third position within the third predetermined time; and determining that the banknote is withdrawn when it is determined that there is a banknote at the first position.

11. The method for detecting the conveyance status of a banknote according to claim 10, wherein when it is determined that the banknote has reached the third position in the banknote passage, the method further comprises:

determining whether the banknote reaches a fourth position in the banknote passage within a fourth predetermined time, wherein the fourth position is at the downstream of the third position, and, when the banknote is at the fourth position, the tail end of the banknote enters a banknote box, neither the first position sensor nor the second position sensor can detect the banknote; wherein the banknote box is arranged at the downstream of the banknote passage and is interconnected with the banknote passage;

detecting whether there is a banknote at the second position and the first position in turn when it is determined that the banknote has not reached the fourth position within the fourth predetermined time; and determining that the banknote is withdrawn when it is determined that there is a banknote at the second position and the first position in turn.

* * * * *